US006811035B2

(12) United States Patent
Axmann

(10) Patent No.: US 6,811,035 B2
(45) Date of Patent: Nov. 2, 2004

(54) DEVICE FOR SORTING FLAT-AREA PIECE GOODS

(75) Inventor: Norbert J Axmann, Sinsheim (DE)

(73) Assignee: Axmann Fordertechnik GmbH, Sinsheim (DE)

( * ) Notice: Subject to any disclaimer, the term of this patent is extended or adjusted under 35 U.S.C. 154(b) by 117 days.

(21) Appl. No.: 10/307,242

(22) Filed: Nov. 29, 2002

(65) Prior Publication Data

US 2003/0127373 A1 Jul. 10, 2003

(30) Foreign Application Priority Data

Nov. 29, 2001 (DE) ..... 101 58 426

(51) Int. Cl.[7] ..... B07B 1/24; B07C 5/06

(52) U.S. Cl. ..... 209/664; 209/369; 209/673; 209/296; 209/299

(58) Field of Search ..... 209/369, 664, 209/673, 296, 297, 299, 288

(56) References Cited

U.S. PATENT DOCUMENTS

| | | | | | |
|---|---|---|---|---|---|
| 19,768 | A | * | 3/1858 | Garretson | 209/288 |
| 475,779 | A | * | 5/1892 | King | 209/369 |
| 553,945 | A | * | 2/1896 | Torrence et al. | 209/268 |
| 745,931 | A | * | 12/1903 | Timons | 209/296 |
| 1,025,791 | A | * | 5/1912 | Dongess | 209/394 |
| 1,728,194 | A | * | 9/1929 | Woodson | 209/673 |
| 2,099,223 | A | * | 11/1937 | Paxton | 209/621 |
| 2,895,610 | A | | 7/1959 | Copping et al. | |
| 3,055,500 | A | * | 9/1962 | Aubert-Maguero | 209/288 |
| 3,794,161 | A | * | 2/1974 | Peterson | 209/540 |
| 4,560,070 | A | * | 12/1985 | Cribiu' et al. | 209/664 |
| 4,600,106 | A | * | 7/1986 | Minardi | 209/662 |
| 4,675,946 | A | * | 6/1987 | Bunge et al. | 452/19 |
| 4,901,863 | A | * | 2/1990 | Lancaster | 209/664 |
| 5,046,711 | A | * | 9/1991 | Merwarth et al. | 271/11 |
| 5,261,854 | A | * | 11/1993 | Eiriksson | 452/19 |
| 5,332,103 | A | * | 7/1994 | Zittel | 209/664 |
| 5,348,162 | A | * | 9/1994 | Wroblewski | 209/35 |
| 2003/0146137 | A1 | * | 8/2003 | Bichel et al. | 209/288 |

FOREIGN PATENT DOCUMENTS

| | | | | |
|---|---|---|---|---|
| DE | 26 37 851 | | 8/1976 | |
| EP | 0 105 431 | | 9/1983 | |
| EP | 1 072 328 | | 1/2001 | |
| FR | 2 177 654 | | 11/1973 | |
| GB | 2 100 691 | | 6/1981 | |
| JP | 62-27774 | * | 2/1987 | 209/667 |

* cited by examiner

*Primary Examiner*—Donald P Walsh
*Assistant Examiner*—Daniel K Schlak
(74) *Attorney, Agent, or Firm*—Collard & Roe, PC

(57) ABSTRACT

A device for sorting flat-area piece goods, particularly packets, packages, and letters. This device has a drum cylinder open towards the outside at both faces, and mounted at an angle to rotate on a bearing body on the mantle surface of the cylinder. The cylinder is structured with longitudinal rollers that rotate about their longitudinal axis, arranged at a distance from one another, mounted on annular flanges, whereby the longitudinal rollers are arranged as steps that extend towards the inside. In each instance, the steps are formed of a roller arrangement of longitudinal rollers. According to an alternative particularly preferred embodiment there is a device with longitudinal rollers that can be put into rotation about their longitudinal axes by a drive. This device has longitudinal rollers that can be put into rotation about their longitudinal axes by the drive. The rotation direction of these rollers can be in the direction of rotation of the drum cylinder in a first circumference region, and rotate opposite the rotation direction of the drum cylinder in a second circumference region.

14 Claims, 6 Drawing Sheets

DEVICE FOR SORTING FLAT-AREA PIECE GOODS

BACKGROUND

The invention relates to a device for sorting flat-area piece goods, such as packets, packages, letters, etc. The device has a drum cylinder open towards its outside at both faces, mounted at an angle to rotate on a bearing body. The mantle surface of the cylinder is structured with longitudinal rollers that rotate about their longitudinal axis, and arranged at a distance from one another, mounted on annular flanges.

Flat-area piece goods, such as packets, packages, and letters, must be sorted with reference to their destination, or town, to allow effective further handling or delivery. Postal codes, in particular, serve as a sorting parameter for packets, packages, letters, etc.

The piece goods arrive in the form of bulk goods, mixed up with one another and on top of one another, in all directions. These piece goods must consequently be sorted and separated by size, and also sorted, to determine the individual sorting parameter assigned to the piece goods, and to be able to sort the piece goods appropriately.

Sorting the piece goods by size is practical if broken up by thickness. These piece goods can be sorted by area, for example, the format or surface area of the piece goods, which preferably have rectangular surfaces.

To sort flat-area piece goods based on area or thickness, sorting devices have generally become known, wherein the piece goods must first be separated along a long sorting line, arranged one behind the other, using conveyor belts. Subsequently, the separated piece goods, conveyed in a line one behind the other, are branched off towards the side or towards the top using special and complicated grasping and/or transport mechanisms to sort them by thickness or by area. These sorting devices are complicated in their design, tend to break down, and have defects. In addition, these devices require a significant amount of set-up area, and throughput or sorting output.

A device for separating individual parts with different shapes and sizes by machine, particularly injection-molded parts, is known from German Patent DE 26 37 851 B1. This device consists of a drum cylinder that is open on both faces, mounted at a slant, so as to rotate. The mantle surface of this design is composed of longitudinal rods mounted in two lateral rings so as to rotate about their longitudinal axis. The rods are arranged at a distance from one another, wherein the rods are structured as mantle rollers that rotate counter to the rotation direction of the drum cylinder.

It is true that this device is practical for separating injection-molded parts into smaller and larger parts. However, it does not meet the special requirements that exist associated with sorting flat-area piece goods, particularly letters.

Only a low sorting output or a poor sorting quality can be achieved with this device for piece goods that easily slide on one another. This problem can be further reinforced due to undesirable catching or jamming of the flat-area piece goods in the mantle slits that can continue to occur, so that permanent disruptions of the sorting process can also occur.

Furthermore, drum devices for sorting flat-area piece goods have become generally known, which have a plurality of longitudinal plates at the mantle circumference. These plates are arranged at a certain incline angle relative to one another, leaving a mantle slit for the piece goods to be sorted out. Undesirable jamming of the flat-area piece goods can occur at the plate edges, in the region of the opening slits, with the possibility of significant damage to the goods.

SUMMARY OF THE INVENTION

Accordingly, it is a task of the invention to create a device which has a simple structure and with which large amounts of piece goods, particularly letters, can be sorted with a high sorting output and a low risk of damage.

The invention relates to a system that has longitudinal rollers that are arranged as steps that extend towards the inside, formed in each instance by a roller arrangement of longitudinal rollers.

The main point of this design is so that the roller mantle has longitudinal rollers that are offset towards the inside. Because of the steps that are formed as a result, the backward slippage of the piece goods that otherwise occur due to gravity when the cylinder is rotated about its longitudinal axis is reduced, and the piece goods are transported further upward within the drum. When this happens, the piece goods can be placed in a more upright position, so that it is easier for them to fall through the gap formed between the steps, such as the roller arrangements. As a result of these measures, which appear to be comparatively simple, the sorting output is clearly increased, without any damage to the flat-area piece goods occurring. Therefore, large amounts of piece goods can be effectively sorted within a short period of time.

The flat-area piece goods can be continuously fed to the drum cylinder, and the piece goods which can be rolled about in the drum can be separated with a high level of sorting quality. Constant sorting can be performed whereby a first part of the piece goods can fall down through the mantle slits, while a second part of piece goods with a greater thickness can be transported away, preferably through one of the face openings of the drum. Further transport of the piece goods within the rotating drum occurs in a simple manner, supported by the force of gravity, as a result of the drum's slanted position in the longitudinal direction. Thus, in this manner, the piece goods are moved along upward a short distance within the drum mantle, during a rotation of the drum. The pieces then fall back, and slowly move in the direction of the drum's longitudinal axis, in the direction of one of the face openings, in accordance with the slanted position of the drum cylinder, where the piece goods with a greater thickness can be transported away.

It is practical if every roller arrangement has the same number of longitudinal rollers, thereby resulting in an advantageous, uniformly good sorting output over the drum circumference.

It is furthermore practical if each of the roller arrangements comprise at least three longitudinal rollers. The outside circumference of these three roller is arranged in a common flat plane. In this way, there can be advantageous guide conditions for piece goods that essentially have small areas. Thus, the sorting output that is also further improved.

According to a practical further development, adjacent roller arrangements extend inward in the rotation direction of the drum cylinder, leaving a passage gap for the piece goods to be sorted out. In addition, adjacent roller arrangements can overlap inward, at least partially, forming a passage gap for the piece goods to be sorted out. With this design, at least one longitudinal roller of each roller arrangement, overlaps at least one longitudinal roller of a directly adjacent roller arrangement, towards the inside. As a result of the above measures, the sorting output and the sorting quality can be further increased.

At least one of the longitudinal rollers should be assigned to be a step, and can be put into rotation about its longitudinal axis via a drive. In this way, the sorting process can be influenced and supported in targeted manner, so that an even greater sorting output is possible.

A set of longitudinal rollers can be put into rotation about their longitudinal axes by the drive and can rotate about their longitudinal axes with the rotation direction of the drum cylinder in a first circumference region. In a second circumferential region, these longitudinal rollers can be put into rotation about their longitudinal axes opposite to the rotation direction of the drum cylinder. In this way, the sorting output can be further effectively increased, without any damage to the piece goods occurring and without any lasting disruption of the sorting process as the result of any wedging of the piece goods that might occur in the region of the passage slits.

In addition, the drive of the longitudinal rollers can comprise at least one auxiliary drive body, which can be brought into direct and/or indirect contact with the longitudinal rollers to be put into rotation about their longitudinal axes. This rotation is in such a way that a rotation of the drum cylinder in the rotation direction results in a rotation of the contacted longitudinal rollers. In this way, a particularly simple and robust design can be created, without any need for separate auxiliary drive units to drive the longitudinal rollers about their longitudinal axes.

It is also practical if the auxiliary drive body is structured as a press-down element that surrounds the outside longitudinal rollers at least partially in the circumference direction of the drum cylinder.

In addition, these auxiliaries are mounted on the annular flange so that it can be moved in the direction of the longitudinal rollers to be put into rotation about their longitudinal axes. In this case, the auxiliary drive body can be placed against them, so that the auxiliary rollers can come into contact with these longitudinal rollers. Using these auxiliary rollers, the longitudinal rollers can rotate in the opposite direction in a simple manner.

It is practical if the auxiliary drive body is structured as an elastic band, such as an elastic tension belt. Such a tension belt is simple and robust, and can be easily handled and replaced, if necessary.

In a particularly preferred exemplary embodiment, the invention relates to a device for sorting flat-area piece goods, particularly packets, packages, letters, and the like, with a drum cylinder open towards the outside at both faces, mounted at an angle so as to rotate on a bearing body. With this design, the mantle surface of the cylinder is structured with longitudinal rollers that rotate about their longitudinal axes, arranged at a distance from one another, and mounted on annular flanges. These longitudinal rollers can be put into rotation about their longitudinal axes via a drive, with the rotation direction of the drum cylinder in a first circumference region. In addition, these rollers can be put into rotation about their longitudinal axes opposite to the rotation direction of the drum cylinder in a second circumference region.

With this design, the sorting output can be effectively increased, without any damage occurring to the flat-area piece goods and without any lasting disruption of the sorting process as the result of any wedging of the piece goods that might occur in the region of the mantle slits. Even if any wedging of the piece goods were to occur in the bottom region of the drum cylinder, wherein the piece goods lie piled up due to the force of gravity, the jammed piece goods are taken along to the second circumference region. This movement occurs as the drum rotates further in the circumference direction, preferably in the upper part of the drum. These pieces are transported back to the interior of the drum, due to the longitudinal rollers that are put into rotation in the opposite direction, so that the plugged-up passage gap becomes open again.

In one embodiment of the invention, a first device and a second device are arranged in a cascade one after the other. If two such drums are set up one behind the other, a first sorting by thickness can take place in the first drum. Thus, it is practical if the passage gaps of the first drum cylinder are selected to be smaller than the passage gaps of the second cylinder. The gaps can be adjusted so that all of the piece goods that are less than 5 mm thick fall through in the first device. This result particularly relates to letters, especially standard letters. In the second drum device, those piece goods that have a thickness of 5 to 10 mm, can then be separated, such as with particularly compact letters. For piece goods with the greatest thickness, such as with a thickness greater than 10 mm, particularly large letters or maxi-letters, can be transported further within the second device and can also be sorted out according to this size class, to this extent.

An intake location for the piece goods of the second device should be arranged below a transfer location of the first device, so that the piece goods that remain at the first device can get from the transfer location of the first device to the intake location of the second device under the force of gravity. It is understood that driven transport devices, particularly conveyor belts, can also be used to transport between the devices arranged in a cascade. As a result of the above measures, the sorting accuracy can be further increased, and result in more effective sorting into several sorting sizes. In other words, there can be almost one hundred percent sorting of the flat-area piece goods by their thickness with such a cascade arrangement of several devices.

It is understood that the distances between the passage gaps for the piece goods can be adjusted differently from one device to another, so that only the thinnest piece goods, or those piece goods in the thinnest size group, are sorted out in the first device. Thus, other sized piece goods that are remaining that can be sorted out in subsequent devices. It is also possible that in the first device, all the piece goods except for those with the greatest thickness can be sorted out, so that the passage gaps are selected to be the largest. In addition, with the subsequent sorting devices with a smaller gap width, these sorting devices sort the piece goods that remain after the first sorting process, in other words those with a smaller thickness.

In the end result, the device can achieve almost one hundred percent sorting of flat-area piece goods that have different thicknesses, into several thickness groups using such cascade arrangements.

It is particularly advantageous if a device for sorting flat-area goods, such as packets, packages, letters, according to their area, is arranged upstream or downstream with reference to a transport direction of the drum cylinder. In this manner, perfect and complete sorting of the flat-area piece goods, particularly of letters, is possible both according to their thickness and according to their area size, in a preferably continuous process, at high sorting output and a high level of sorting quality, without subjecting the piece goods to relevant damage.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
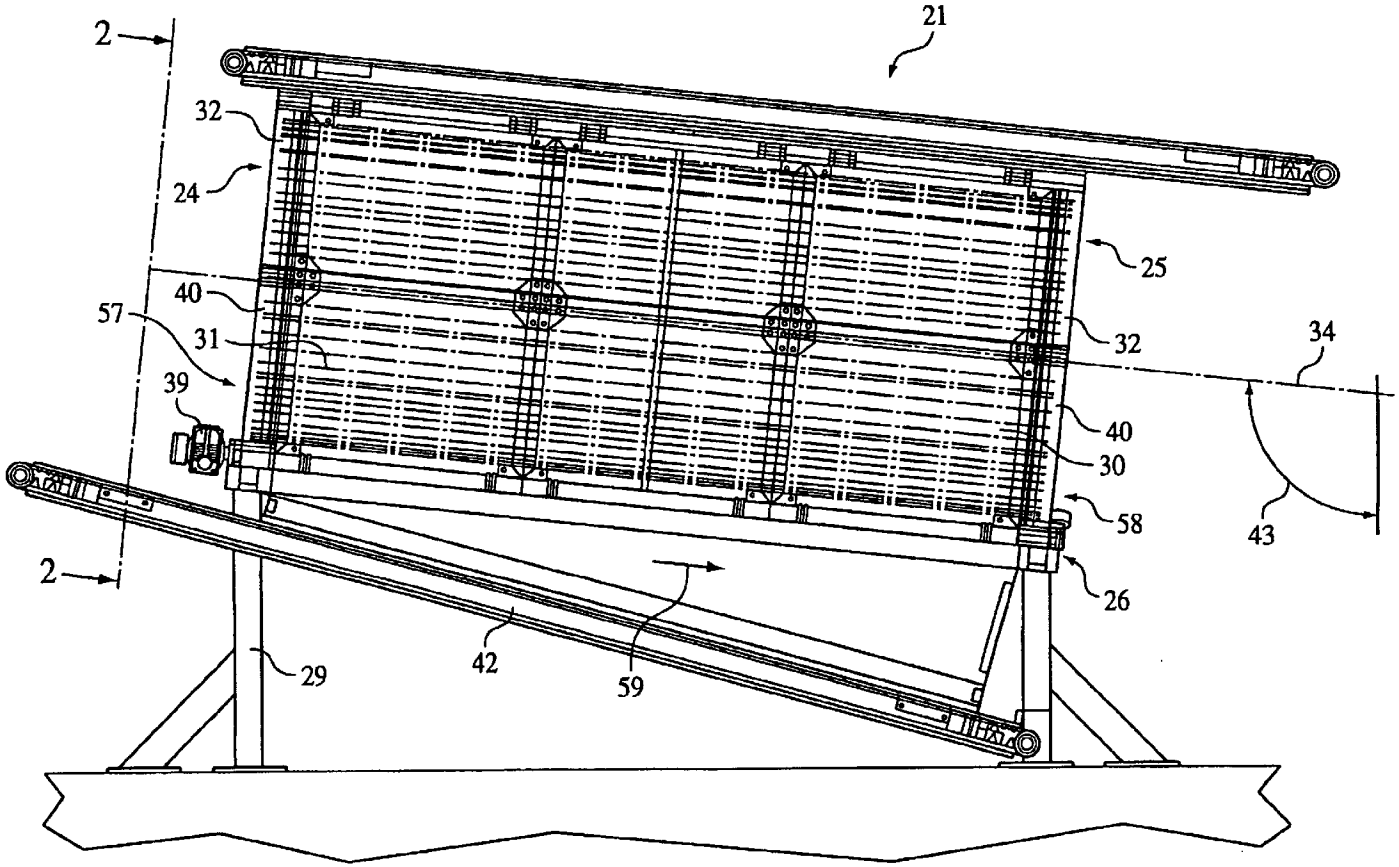
FIG. 1 is a longitudinal side view of a first embodiment of a sorting device.

Referring to the drawings, FIG. 1 shows device 21 that sorts flat-area piece goods 27, which are letters 28 of different thickness. It is known that letters 28 can be divided into several format or area related and thickness-related groups, in accordance with country-specific conditions, whereby these size groups are usually assigned to a specific price category. For example, a differentiation is made between standard letters with a thickness of less than 5 mm, compact letters with a thickness of less than 10 mm, large letters with a thickness of less than 20 mm, and maxi-letters with a thickness of less than 50 mm. In this case, each thickness group has specific limits with regard to the size such as the length and width of the letters, assigned to it at the same time.

Device 21 comprises drum cylinder 30 that is open towards its outside at both faces 24. Drum cylinder 30 is mounted at a slant, at a specific angle 43 relative to a vertical axis or perpendicular, so as to rotate, on a bearing body 26 that is structured as a frame 29. Its mantle surface 31 is structured with longitudinal rollers 35 (see FIG. 2) that rotate about their longitudinal axis 45, arranged at a distance 63, 64 (see FIG. 4) from one another, mounted on lateral annular flanges 32. In the embodiment shown in FIGS. 1, 2, and 5, longitudinal rollers 35 can be directly put into rotation about their longitudinal axes 45 via a drive 38, which is structured as a gear motor 39.

Figure 2:
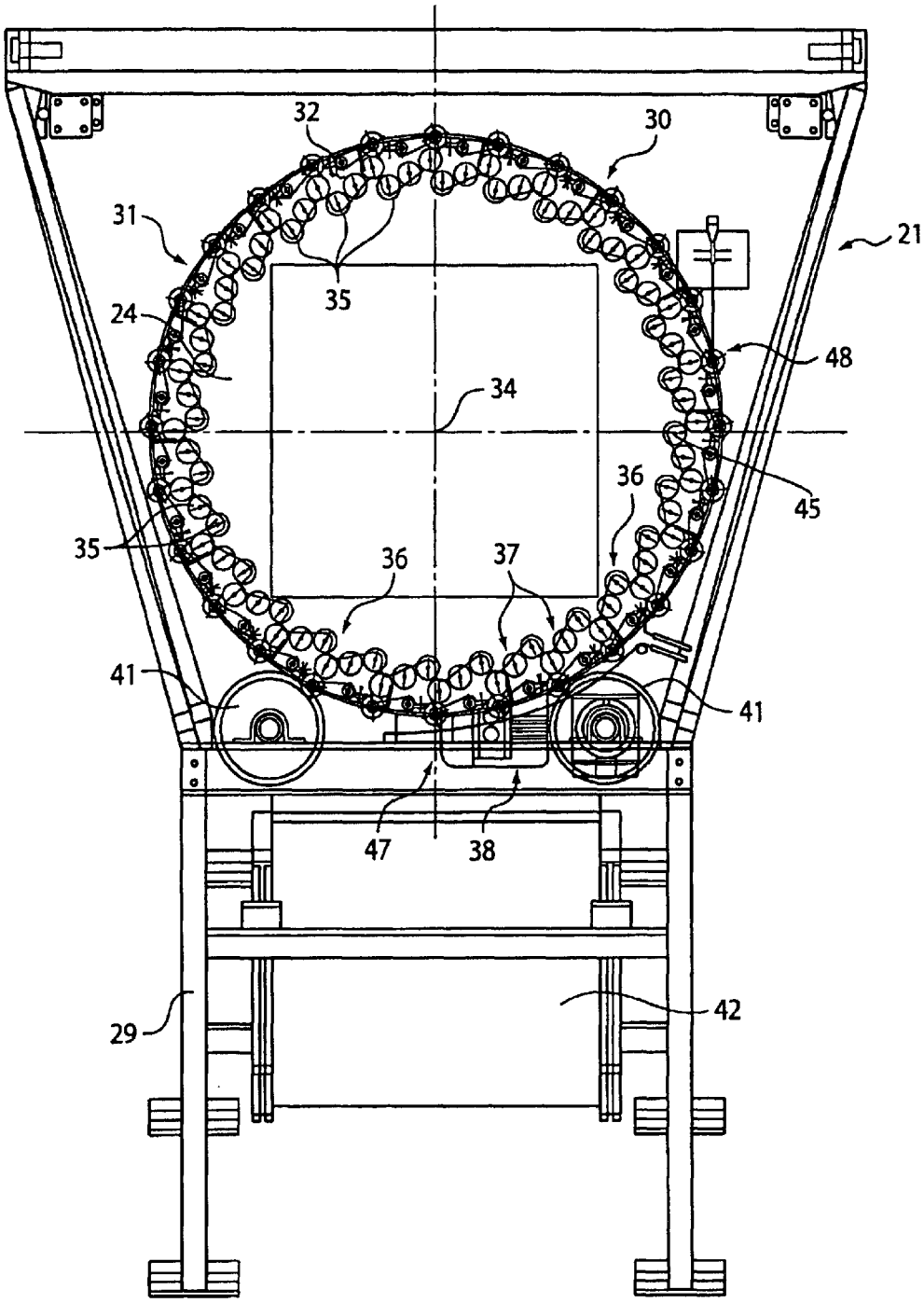
FIG. 2 is a cross-sectional view of the device according to FIG. 1, along the cross-section lines 2—2.

As shown in FIG. 2, two annular flanges 32 are mounted to be guided on two bearing and drive rollers 41 that are mounted on the frame so as to rotate, in each instance. Gear motor 39 (see FIG. 1) drives at least one of the bearing and drive rollers 41, which in turn is in frictional contact with the outside circumference of at least one of the annular flanges 32. In this way, drum cylinder 30 can be put into rotation about its longitudinal axis of rotation 34, in rotation direction 49. This action is controlled by gear motor 39, by way of the at least one bearing and drive roller 41.

Figure 3:
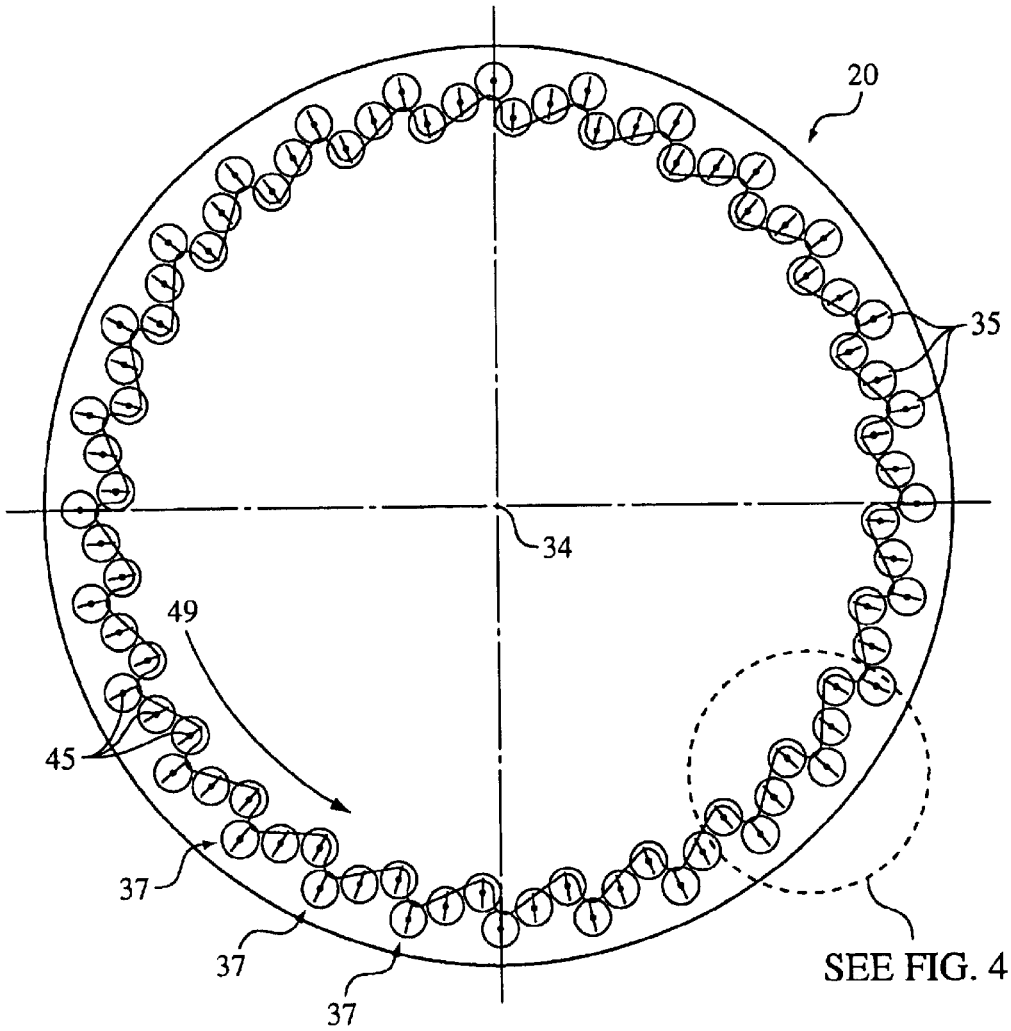
FIG. 3 is a partially schematic face-side partial view of an alternative embodiment variant of the invention.
Figure 5:
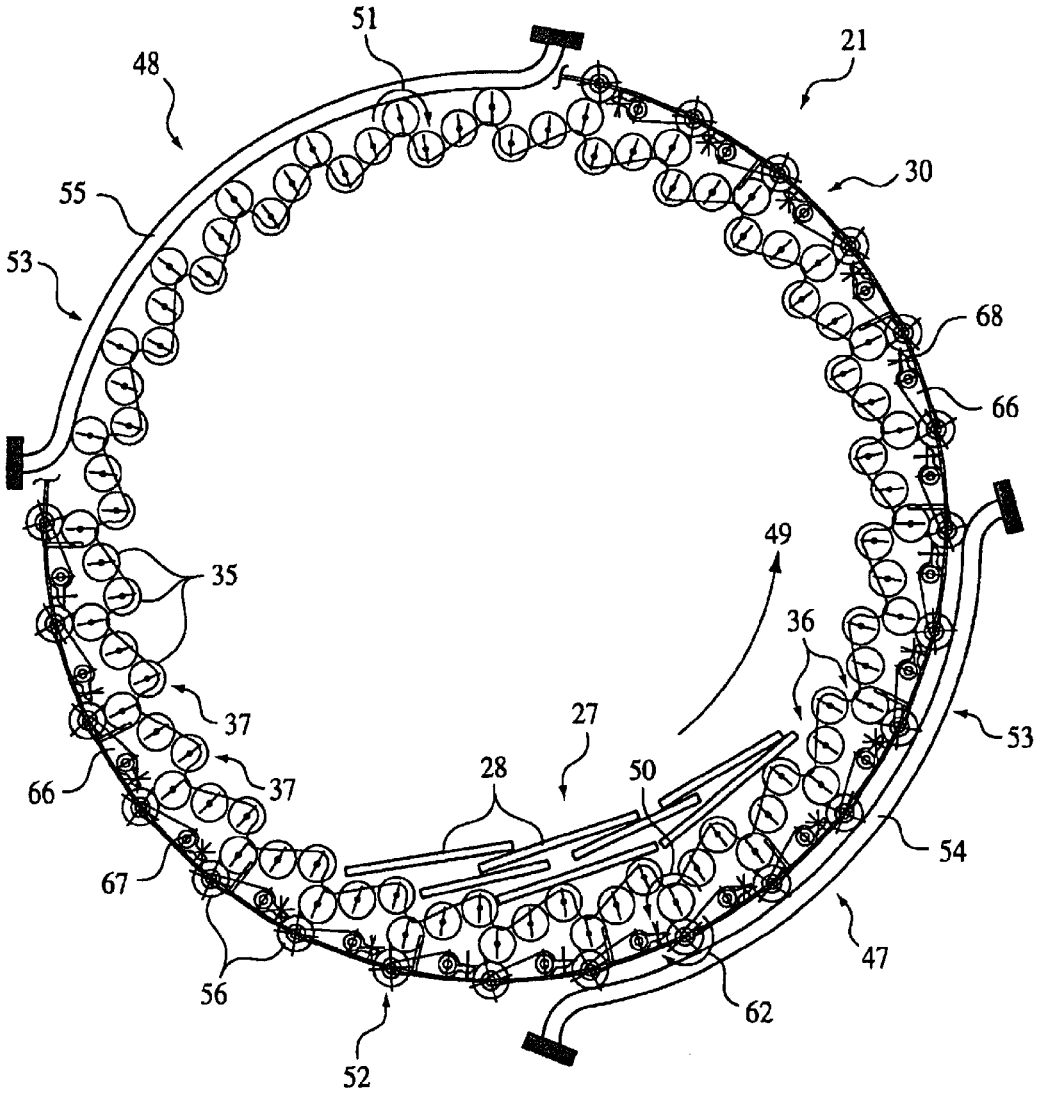
FIG. 5 is a partially schematic face-side partial view with a partial cross-section of the device according to FIG. 2.

Longitudinal rollers 35, which have only a slight mass inertia, are each rigidly connected and rotatably mounted on annular flanges 32, on both ends. As a result, all of longitudinal rollers 35 rotate with drum cylinder 30 when it rotates about its longitudinal axis 34. FIGS. 3 and 5 show this rotation is in rotation direction 49 indicated by an arrow. Therefore, if as shown in FIG. 5, letters 28 have been put into the drum cylinder 30 at intake location 57, they first rotate in rotation direction 49.

Figure 4:
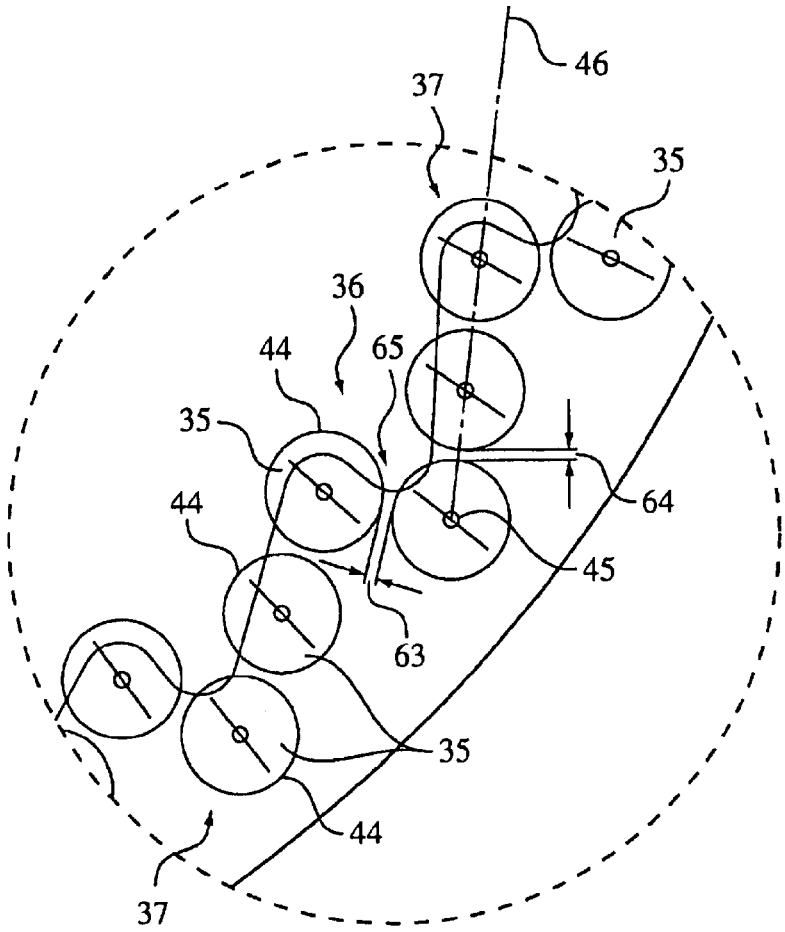
FIG. 4 is a detailed view of FIG. 3, on a larger scale, to clarify the distance and gap relationships between the longitudinal rollers and the roller arrangements.

As shown in FIG. 4, each roller arrangement 37 consists of longitudinal rollers 35, which are each arranged so that their outside circumference 44, is arranged in a common flat plane 46. This is compulsory in the present case, since the longitudinal rollers each have the same outside diameter, and since their longitudinal axes of rotation 45 are arranged in a common flat plane. Each of these roller arrangements 37 is inclined at a slant towards the inside, relative to the immediately adjacent roller arrangement 37, in rotation direction 49. The longitudinal roller 35 of a roller arrangement 37 that lies on the inside, in each instance, lies offset towards the inside relative to longitudinal roller 35 of the immediately adjacent roller arrangement 37 in the rotation direction 49 that is farthest towards the outside. As a result, in each instance, the immediately adjacent roller arrangements overlap towards the inside.

The rollers of roller arrangement 37 are each spaced apart by a gap 64 relative to one another, so that each of these longitudinal rollers 35 of a common roller arrangement 37 can rotate independent of the other longitudinal rollers 35. A passage gap 65, which has a slit width 63, is formed between the immediately adjacent roller arrangements 37, in each instance, in the region of their overlapping longitudinal rollers 35, and extends in the longitudinal direction of the drum cylinder 30. This slit width 63 is adjusted to a certain thickness of the piece goods 28 to be sorted out, so that the piece goods that are below a certain thickness can fall through passage gap 65, downwards, due to the force of gravity. In addition, piece goods 27 that have a greater thickness are held back in drum cylinder 30, and can slowly get from intake location 57 to transfer location 58 as a result of the drum's slanted position at an angle 43, between its longitudinal axis of rotation 34 and the perpendicular, of greater than 90°. In addition these piece goods migrate because drum cylinder 30 rotates in circumference direction 49, from where they can be transported away. The piece goods that fall out in a downward direction can be transported away using conveyor belt 42 as shown in FIG. 1.

It is understood that slit width 63 of passage gap 65 can be adjusted to different sizes, depending on the user requirements. The design of drum cylinder 30 can be made so that a specific minimum slit width 63 can be adjusted between longitudinal rollers 35, which have a specific maximum outside diameter. In this case, slit width 63 can be enlarged accordingly, in simple manner, by replacing longitudinal rollers 35 with longitudinal rollers that have a smaller outside diameter, so that correspondingly thicker piece goods can be separated from even thicker piece goods, and sorted out.

It is understood that the relationships shown in greater detail in FIG. 4 and explained above, concerning the distances between longitudinal rollers 35 and slit width 63, and the arrangement of longitudinal rollers 35, can also be selected based upon the embodiments shown in FIGS. 1, 2, 5, and 6.

In the embodiment shown in FIG. 3, individual longitudinal rollers 35 are not put into rotation about their longitudinal axes 45. Instead, these longitudinal rollers 35 are also mounted to rotate. Accordingly, in this embodiment of a sorting device 20, longitudinal rollers 35 are advantageously designed as steps 36 that are formed from a roller arrangement 37 of longitudinal rollers 35, that in each instance extend inward. Piece goods 27, such as letters 28, can advantageously support themselves against steps 36, in the region of longitudinal rollers 35. These roller arrangements 37 are arranged directly adjacent to one another and which in each instance lie opposite one another, forming a passage gap 65. In addition, longitudinal rollers 35 that in each instance lie directly opposite one another, are separated only by passage gap 65, during the course of the rotation of drum cylinder 30 in rotation direction 49. Longitudinal rollers 35 are positioned so that piece goods 28 are taken along towards the top in rotation direction 49, by a specification rotation angle. In addition, these piece goods can stand upright as a result of the rotation of the drum cylinder 30. These piece goods can easily fall out towards the bottom, due to the force of gravity, through passage gap 65, as shown in FIG. 3, as a result of the free ability of the longitudinal rollers 35 to rotate relative to one another.

In another embodiment shown in FIGS. 1, 2, 5, and 6, longitudinal rollers 35 are arranged radially the farthest towards the outside, in each instance, and can be put into rotation about their longitudinal axes 45, directly or indirectly, via a drive 38. For this purpose, an elastic band 54 (see FIG. 5) is structured as a press-down element 53, which is also referred to as an auxiliary drive body 52. Press down element 53 is arranged in a first, lower circumference region 47 of drum cylinder 30, and a second elastic band 55 is arranged in a second, upper region 48 of drum cylinder 30. Second elastic band 55 bands partially surround drum cylinder 30, and longitudinal rollers 35 that form it, in the stated circumference regions 47 and 48.

As shown in FIG. 5, auxiliary rollers 56 are mounted to rotate on at least one of the annular flanges 32, preferably on both annular flanges 32. Flanges 32 are distributed at the same circumference distance around the outside circumference of drum cylinder 30. Drum cylinder 30 is rigidly connected to each annular flange 32. Each of these auxiliary rollers 56 is mounted to rotate on a pivot lever 66, which in turn can be pivoted about its pivot axis 67, in the direction towards the longitudinal rollers that are arranged the farthest towards the outside on the mantle circumference, in each instance. It is important that auxiliary rollers 56 not tip away downwards in the intermediate regions, wherein they do not rest against one of the bands 54. Therefore, each pivot lever 66 has a support projection 68, on its other free end, which lies opposite the pivot axis 67, wherein this projection in turn can come to rest against a pin rigidly connected with annular flange 32.

There is another circumference region 47 that is evident from FIG. 5, such as the region in which letters 28 are piled on top of one another due to the force of gravity. This region extends in the rotation direction 49 of the drum cylinder 30. In this region there is an elastic band 54 that is arranged such that it can come to rest against a plurality of auxiliary rollers 56, on the outside, with a sufficiently great press-down pressure so that the auxiliary rollers 56 can be brought into a friction connection with the band 54. Within the course of a revolution of drum cylinder 30 in rotation direction 49, auxiliary rollers 56 that rotate along with drum cylinder 35 about its longitudinal axis of rotation 34, run up against the band 54, with the result that these auxiliary rollers 56 rotate about their longitudinal axis, in the rotation direction 62 shown in FIG. 5, such as in a clockwise direction. In this connection, the press-down force of band 54 is adjusted so that auxiliary rollers 56 rest against longitudinal rollers 35 that each lie directly opposite them, and that each lie farthest towards the outside, and are also in frictional contact with them. In this way, a rotation of drum cylinder 30 in rotation direction 49 results in a rotation of longitudinal rollers that lie farthest towards the outside, in rotation direction 50 shown in FIG. 5. This process occurs counter-clockwise, and accordingly opposite the rotation direction 62 of auxiliary rollers 56.

Therefore, in circumference region 47, each outside longitudinal rollers 35 of roller arrangement 37, rotate in a rotation direction 50, which conveys a letter 28 that rests against this region of step 36 towards the outside, for example through passage gap 65. Therefore, the jamming of letters 28 that lie one top of the other can be prevented in this region, because a letter that lies directly against a longitudinal roller 35 can be put into rotation about its longitudinal axis 45, and can be driven, is transported away towards the outside.

If, in spite of this, a number of letters 28 were to become wedged in the region of passage gap 65, these letters 28 are taken along during a rotation of the drum cylinder 30 in rotation direction 49. Without additional measures, these letters 28, block up the passage gap 65, because they are jammed there, and would get to the bottom again in the course of their circulation. To avoid a stopped up passage gap, another elastic band 55 is provided in an upper circumference region 48 of the drum cylinder 30. Elastic bands 5 surround drum cylinder 30, and longitudinal rollers 35, by a certain circumference angle. However, in contrast to the band 54, band 55 is arranged so that it can be pressed down directly against each of the longitudinal rollers 35 that lie the furthest towards the outside. As a result, these longitudinal rollers 35 rotate in a clockwise rotation direction 51, when band 55 is applied and with the rotation direction 49 of the drum cylinder 30 selected in FIG. 5. Thus, this rotation direction 51 is opposite rotation direction 50 of longitudinal rollers 34 adjacent lower band 54. Because of this rotation of the longitudinal rollers 35 that lie opposite the upper band 55, the letters 28 that might be jammed in the related passage gap 65 are transported back into the interior of drum cylinder 30, so that the blockage of passage gap 65 is eliminated. In this manner, the result is achieved that in the region in which the piece goods to be sorted, such as letters 28, always rest on the longitudinal rollers 35 that lie on the inside, in each instance, due to the force of gravity, after they have been filled into, or placed into the drum cylinder 30. Thus, there are always open passage gaps 65 available for separating the letters 28 that have a different thickness, so that a uniformly high sorting output can always be achieved.

In a particularly advantageous use, one or preferably several of the devices according to the invention for sorting piece goods 27 according to their thickness, are combined, within a sorting system. This system includes one or more devices for sorting flat-area piece goods, particularly packets, packages, letters, etc. according to their area size, to achieve an advantageous and complete sorting by size of the piece goods. This sorting is according to their thickness and according to their area.

Figure 6:
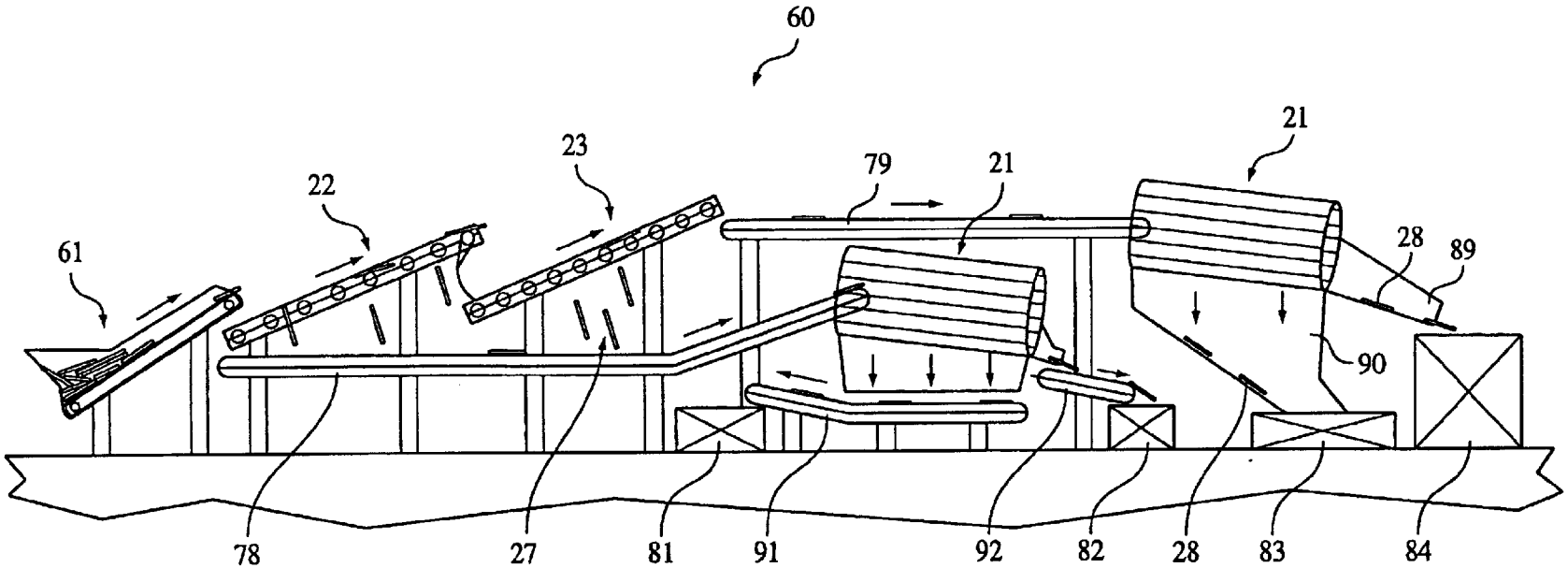
FIG. 6 is a schematic view of a sorting device with two devices according to the invention, for sorting flat-area piece goods, by their thickness, and two devices for sorting by area.

A preferred exemplary embodiment of such a sorting system 60 is shown in FIG. 6. With this design, two devices 21, 22 are provided for sorting the piece goods 27, particularly letters, according to their thickness. These designs differ particularly in the slit width 63 of their passage gaps 65, and thereby allow separation and sorting of piece goods with a different thickness. In the embodiment shown, these devices 21 and 22 are preceded by two devices 22, 23 for sorting piece goods 27 according to their format or area. In this connection, the piece goods, which are delivered as bulk goods, can first be placed into an intake unit 61, and from there be placed onto one of the devices 22 for sorting the piece goods 67 according to their area or format. This process occurs by way of an assigned conveyor belt. Using the stated devices 22, 23, letters, in particular, can be separated, or sorted so that the letters that have smaller outside area dimensions, particularly standard letters, can fall down onto the conveyor belt 78, while the letters having larger area dimensions, particularly compact letters, are transported onto conveyor belt 79. From conveyor belt 78, the smaller letters get into intake location 57 of device 21, formed with a drum cylinder. In this drum device, the standard letters are sorted by their thickness, wherein the letters or piece goods with a smaller thickness fall out and down onto conveyor belt 91, wherein they are transported into container 81, while the piece goods sorted out at the transfer location of first device 21, having a greater thickness, are transported into container 82 by way of conveyor belt 92. The piece goods having larger outside area dimensions get to the intake location of the second device according to the invention, for sorting them according to their thickness, by way of conveyor belt 79. In this device 22, these larger piece goods 27 are in turn sorted by their thickness, so that the piece goods, such as letters having a smaller thickness are transported into container 83 via guide body 90, due to the force of gravity. In addition, the piece goods with the greater outside area dimensions, and having a greater thickness are transported into the container 84 via guide body 89.

It is understood that several devices 20, 21, 22 for sorting the piece goods 27 according to their thickness can be arranged in a cascade, one behind the other, either while simultaneously reducing the slit width of the passage gaps, in each instance, or without changing these slit widths, where this can be adjusted as a function of the user needs and the special properties of the piece goods to be sorted.

Accordingly, while at least one embodiment of the present invention has been shown and described, it is to be understood that many changes and modifications may be made thereunto without departing from the spirit and scope of the invention as defined in the appended claims.

What is claimed is:

1. A device for sorting flat area piece goods such as packets, packages, and letters, the device comprising:

a) a drum cylinder having at least two open ends;

b) a plurality of longitudinal rollers wherein each roller rotates about a longitudinal axis;

c) a plurality of annular flanges, wherein each of said plurality of longitudinal rollers is mounted on at least one of said plurality of annular flanges;

d) a plurality of roller arrangements formed by said plurality of longitudinal rollers, said plurality roller arrangements forming a plurality of steps wherein said plurality of longitudinal rollers are arranged as inward extending in each of said plurality of steps in said plurality of roller arrangements; and e) a drive for driving at least one of said plurality of longitudinal rollers about its longitudinal axis in a rotation direction of said drum cylinder in a first circumferential region, and wherein said drive drives said plurality of rollers in a rotation direction opposite said rotation direction of said drum cylinder in a second circumference region.

2. The device as in claim 1, wherein each of said plurality of roller arrangements comprises an identical number of longitudinal rollers.

3. The device as in claim 2, wherein each of said plurality of roller arrangements comprises at least three longitudinal rollers each having an outside circumference that is arranged in a common flat plane.

4. The device as in claim 1, wherein each of said plurality of roller arrangements extend inward to form a passage gap between each of said plurality of roller arrangements wherein said passage gap allows piece goods to be sorted out.

5. The device as in claim 1, wherein said plurality of roller arrangements are disposed adjacent to each other and said adjacent roller arrangements overlap each other inwardly forming a passage gap for sorting said piece goods.

6. The device as in claim 5, wherein at least one longitudinal roller of a roller arrangement overlaps at least one longitudinal roller of an adjacent roller arrangement.

7. The device as in claim 1, further comprising at least one auxiliary drive body disposed adjacent to said plurality of longitudinal rollers wherein a rotation of said drum cylinder results in a rotation of said plurality of longitudinal rollers.

8. The device as in claim 7, wherein said auxiliary drive body is formed as a press-down element that surrounds an outside region of said plurality of longitudinal rollers in a circumferential direction of said drum cylinder.

9. The device as in claim 8, wherein said auxiliary drive body comprises a plurality of auxiliary rollers that can contact said plurality of longitudinal rollers.

10. The device as in claim 7, wherein said auxiliary drive body is in a form of an elastic band.

11. A system for sorting flat area piece goods such as packets, packages, and letters, comprised of a plurality of sorting devices each comprising:

a) a drum cylinder having at least two open ends;

b) a plurality of longitudinal rollers wherein each roller rotates about a longitudinal axis;

c) a plurality of annular flanges, wherein each of said plurality of longitudinal rollers is mounted on at least one of said plurality of annular flanges;

d) a plurality of roller arrangements formed by said plurality of longitudinal rollers, said plurality of roller arrangements forming a plurality of steps wherein said plurality of longitudinal rollers are arranged as inward extending in each of said plurality of steps in said plurality of roller arrangements; and e) a drive for driving at least one of said plurality of longitudinal rollers about its longitudinal axis in a rotation direction of said drum cylinder in a first circumferential region, and wherein said drive drives said plurality of rollers in a rotation direction opposite said rotation direction of said drum cylinder in a second circumference region.

12. The system as in claim 11, wherein the plurality of the devices can be arranged in a cascading manner.

13. The system as in claim 12, wherein the plurality of sorting devices include a first device and a second device and wherein said first device has a transport location for piece goods, and said second device has a transport location for piece goods located downstream relative to the first device, with reference to its transport direction.

14. The system according to claim 13, wherein the plurality of sorting devices includes at least one device that sorts flat area piece goods.

* * * * *